US006540419B2

(12) United States Patent
Plumley et al.

(10) Patent No.: US 6,540,419 B2
(45) Date of Patent: Apr. 1, 2003

(54) MULTI-MODE CONTINUOUS PRINTING

(75) Inventors: A. Bruce Plumley, Middletown, CT (US); Matthew Reardon, Tolland, CT (US)

(73) Assignee: Gerber Technology, Inc., Tolland, CT (US)

( * ) Notice: Subject to any disclaimer, the term of this patent is extended or adjusted under 35 U.S.C. 154(b) by 0 days.

(21) Appl. No.: 09/934,211

(22) Filed: Aug. 21, 2001

(65) Prior Publication Data

US 2003/0039502 A1 Feb. 27, 2003

(51) Int. Cl.[7] ..... B41J 11/46

(52) U.S. Cl. ..... 400/582; 400/578

(58) Field of Search ..... 400/582, 578

(56) References Cited

U.S. PATENT DOCUMENTS 3,711,646 A * 1/1973 Vermilion et al. ..... 178/25
6,056,454 A 5/2000 Plumley et al.
6,076,983 A 6/2000 Stein et al.

FOREIGN PATENT DOCUMENTS

EP 0992353 A1 4/2000
GB 2359047 A 8/2001

* cited by examiner

*Primary Examiner*—Andrew H. Hirshfeld
*Assistant Examiner*—Charles H. Nolan, Jr.
(74) *Attorney, Agent, or Firm*—McCormick, Paulding & Huber LLP

(57) ABSTRACT

In a printer having a continuously moving web, a method is disclosed for accelerating the moving web in the areas where printing is not to occur such that the throughput of the print can be increased without sacrificing print quality.

5 Claims, 9 Drawing Sheets

MULTI-MODE CONTINUOUS PRINTING

FIELD OF THE INVENTION

The present invention relates generally to printing on continuously moving sheet-type work materials using inkjet, dot matrix, thermal, or like print heads, and deals more particularly with a method for increasing the throughput of a printing apparatus wherein the web moves continuously.

BACKGROUND OF THE INVENTION

Printing apparatuses that print on a continuously moving web are well known in the art. Examples include the printing apparatuses disclosed in U.S. Pat. No. 6,076,983 entitled "Method and Apparatus for Printing onto a Continuously Advancing Web of Work Material" and U.S. Pat. No. 6,056,454 entitled "Method and Apparatus-for Printing on a Continuously Moving Sheet of Work Material," both of which are assigned to Gerber Technology, Inc., the assignee of this application. Both patents are incorporated in their entirety herein by reference.

These patents are each directed to apparatuses and methods for printing on a continuously moving sheet of work material (hereinafter a web) that includes a frame defining a work supporting surface and a web that continuously advances through the apparatus in an X coordinate direction longitudinal of itself, and a print head positioned above the work supporting surface such that the web can pass between the print head and the work supporting surface. The print head is positioned adjacent the work supporting surface continuously moves the print head across the work supporting surface such that printing can occur in both an X coordinate direction and a Y coordinate direction approximately perpendicular to the X direction, thereby permitting lineal lines of print positioned proximate to and abutting one another to be printed on the continuously moving web. This would for example allow a continuous graphic to be printed without stopping the forward continuous advancement of the web.

A difficulty associated with printers of this type is that the web throughput is constrained by print head printing speeds. In an effort to address this problem, efforts have been made to increase the rate at which the print head transferred ink or other print media to the web. However, a problem still exists in that the speed at which the web is advanced remains unacceptably slow.

It would be beneficial if printing rates could be varied in those areas where the print head is not required to transfer ink, or other print media, to the web, hereinafter referred to as white space. For example, when a plurality of pattern pieces are arranged upon a marker for printing, white space (non-printer-dictated, unprinted areas between pieces) is inevitable. White space may also occur within a piece. White space can be lineal (within the print line) or longitudinal (across at least one print line). Accordingly, a need exists for a printer whereby the print speed can be increased in the areas of white space. Based on the foregoing, it is the general object of the present invention to provide a printer and method for controlling the printer that overcomes the problem and drawbacks of prior art printers.

SUMMARY OF THE PRESENT INVENTION

The present invention is directed in one aspect to a method for varying the rate of advancement of a continuously advancing web through a printer. To practice this method, a printer is provided having means for continuously advancing a web of sheet-type work material therethrough in a first coordinate direction longitudinal of itself. The printer also includes a print head movable, in response to commands signals generated by a controller, in the first coordinate direction, and also in a second coordinate direction approximately perpendicular to the first coordinate direction. The controller is in communication with the printer and sends command signals thereto to operate the printer during the performance of a printing operation. Data corresponding to a desired printed graphic is stored in the controller in a format, e.g. machine language, understandable by the printer.

The printer also includes a print head coupled thereto and movable in the first coordinate direction as well as a second coordinate direction approximately perpendicular to the first. The co-action of the continuously advancing web, and the motion of the print head, allow lineal lines of print media to be transferred onto the web by the print head along a path approximately perpendicular to the first coordinate direction in response to command signals generated by the controller. Depending on the desired graphic to be printed, the lineal lines of print media can abut one another so that a continuous image is generated.

The controller is programmed to evaluate the graphic data stored therein to detect non-printed areas or white space. During a printing operation the continuous advancement of the web, as well as movement of the print head can be adjusted so that the rate of movement of the print head, the rate of advancement of the web, or both are varied to accelerate through the white space. This has the advantage of decreasing the time required to complete a printing operation. Where multiple graphics are to be printed in a single printing operation, the controller is also programmed to account for areas of white space between graphics and accelerates the print head and/or the advancement of the web accordingly.

Preferably, the printer employed in the method of the present invention includes a frame and means for continuously advancing the web in the first coordinate direction longitudinally of itself at a velocity $\upsilon_{wx}$ relative to the frame. At least one print head is coupled to the frame for movement relative thereto; the print head includes a plurality of print elements arranged in a scanning array extending in the first coordinate direction. Means are provided for repetitively moving the scanning array of print elements relative to the frame along a path including at least one scan segment and one repositioning segment at such a velocity $\upsilon_a$ related to the web velocity $\upsilon_{wx}$ that as the scanning array traverses the scan segment of the path the scanning array has a first velocity component $\upsilon_{ax}$ in the first coordinate direction, and a second velocity component $\upsilon_{ay}$ in a second coordinate direction approximately perpendicular to the first coordinate direction.

The means for repetitively moving the scanning array of print elements further is such that the first velocity component $\upsilon_{ax}$ is equal to $\upsilon_{wx}$ so that the scanning array in traversing the scan segment of the path scans a swath on the web parallel to the first coordinate direction. The scanned swath has a swath height $h_s$. Moreover, the means for repetitively moving the scanning array of print elements moves such that in the time required for moving the scanning array along the full extent of the scan segment of the path the web advances a distance $h_w$ in the first coordinate direction that is less than the swath height $h_s$.

Upon traversing the scan segment the scanning array travels along the repositioning segment such that prior or equal to a time taken for the web to advance a distance d, where $d=h_s-h_w$ the print head is repositioned for immediate movement along a scan segment thereby causing successive swaths of the web scanned by the scanning array to be positioned on the continuously advancing web immediately adjacent to one another. When white space is encountered, the controller generates command signals receivable by the printer that cause a respective one, or all of the velocity components $\upsilon_w$, $\upsilon_{ax}$, $\upsilon_{ay}$ to accelerate over the white space.

The scanning array can also follow a figure-8 shaped path relative to the frame. To accomplish this the scanning array must travel along a first scan segment having first and second ends, and a second scan segment having third and forth ends, each extending transversely across said web. In addition the first scan segment is oriented at a first angle relative to the X coordinate direction, and the second scan segment is oriented at a second angle approximately equal and opposite to the first angle. Preferably, the second scan segment has a third and forth end adjacent to the second and first ends respectively, of the first scan segment.

In this embodiment a first repositioning segment extends between the and fourth ends of the first and second scan segments respectively. A second repositioning segment also extends between the second and third ends of the first and second scan segments respectively. During operation, the scanning array traverses the first scan segment of the path from the first to the second end at a velocity having a first velocity component $\upsilon_{1ay}$ in the X coordinate direction, and a second velocity component $\upsilon_{1ay}$ in the Y coordinate direction. In this manner, the scanning array scans a first swath on the web parallel to the Y coordinate direction having a first swath height $h_{1s}$.

As the scanning array traverses the first scan segment, the second velocity component $\upsilon_{1ay}$ is such that in the time required for the array to traverse the full extent of the first scan segment, the web advances a distance $h_w$ in the X coordinate direction that is less than the first swath height $h_{1s}$. Upon traversing the full extent of the first scan segment the scanning array travels along the first repositioning segment in a time less than or equal to the time taken for the web to advance a distance $d_1$, where $d_1=h_{1s}-h_{1w}$. The print head is now repositioned for immediate movement along the second scan segment.

The scanning array next traverses the second scan segment at a velocity $\upsilon_{2a}$ wherein the first velocity component is $\upsilon_{2ax}$, and the second velocity component is $-\upsilon_{2ay}$ that has a magnitude equal to, and a direction opposite to the second velocity component $-\upsilon_{2ay}$. In traversing the second scan segment, the scanning array scans a second swath on the web parallel to said Y coordinate direction, having a second swath height $h_{2s}$. The velocity component $-\upsilon_{2ay}$ is such that in the time required for the scanning array to traverse the full extent of the second scan segment the web advances the distance $h_{2w}$ in said X coordinate direction which is less than the second swath height $h_{2s}$.

Accordingly, upon traversing the full extent of the second scan segment the scanning array travels along the second repositioning segment in a time less than or equal to the time taken for the web to advance a distance $d_2$, where $d_2=h_{2s}-h_{2w}$. In this manner the print head is repositioned for immediate movement along first scan segment, such that the path traveled by the scanning array is figure-8-shaped relative to the frame. As described above, the controller will cause the printer to accelerate the advancement of the web, or the movement of print head, or both to accelerate past white space.

An advantage of the present invention is that the printer not only continuously advances the web thereby lowering printing times over those of more conventional printers, but further lowers print times by accelerating the advancement of the web, or the movement of the print head, or both over non-print areas or white space.

DETAILED DESCRIPTION OF THE PREFERRED EMBODIMENTS OF THE PRESENT INVENTION

Figure 1:
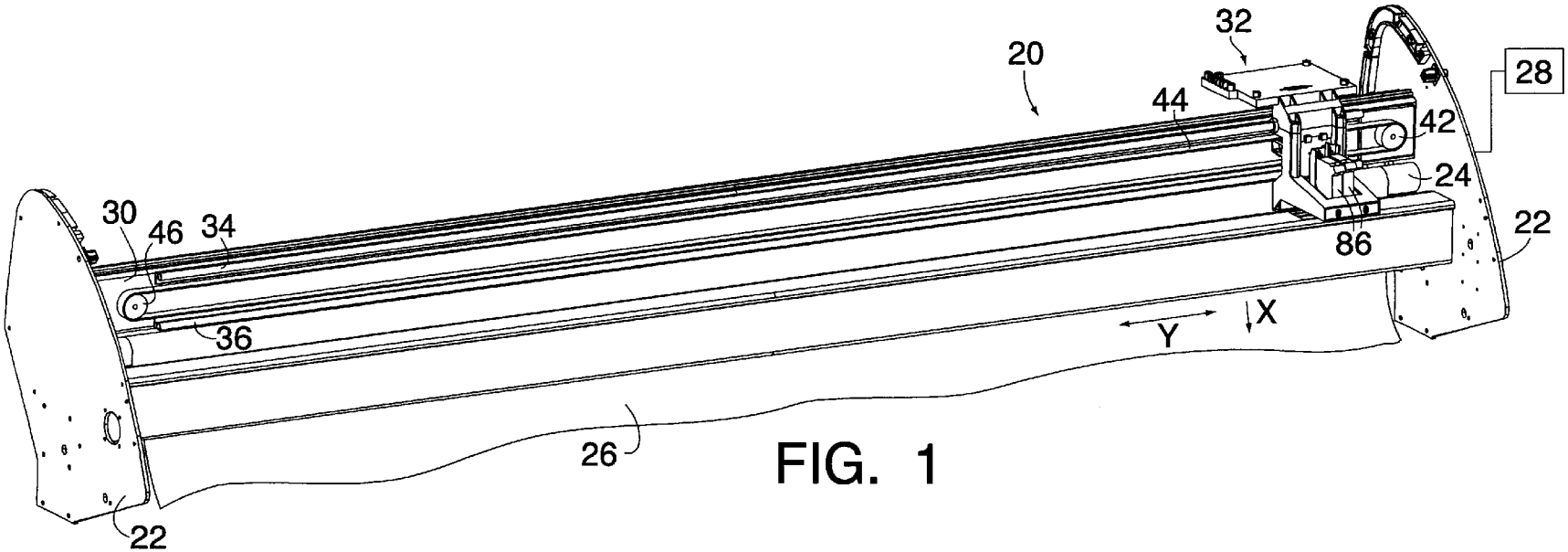
FIG. 1 is a partial perspective view of an embodiment of the apparatus of the present invention for printing onto a continuously advancing web of work material.
Figure 2:
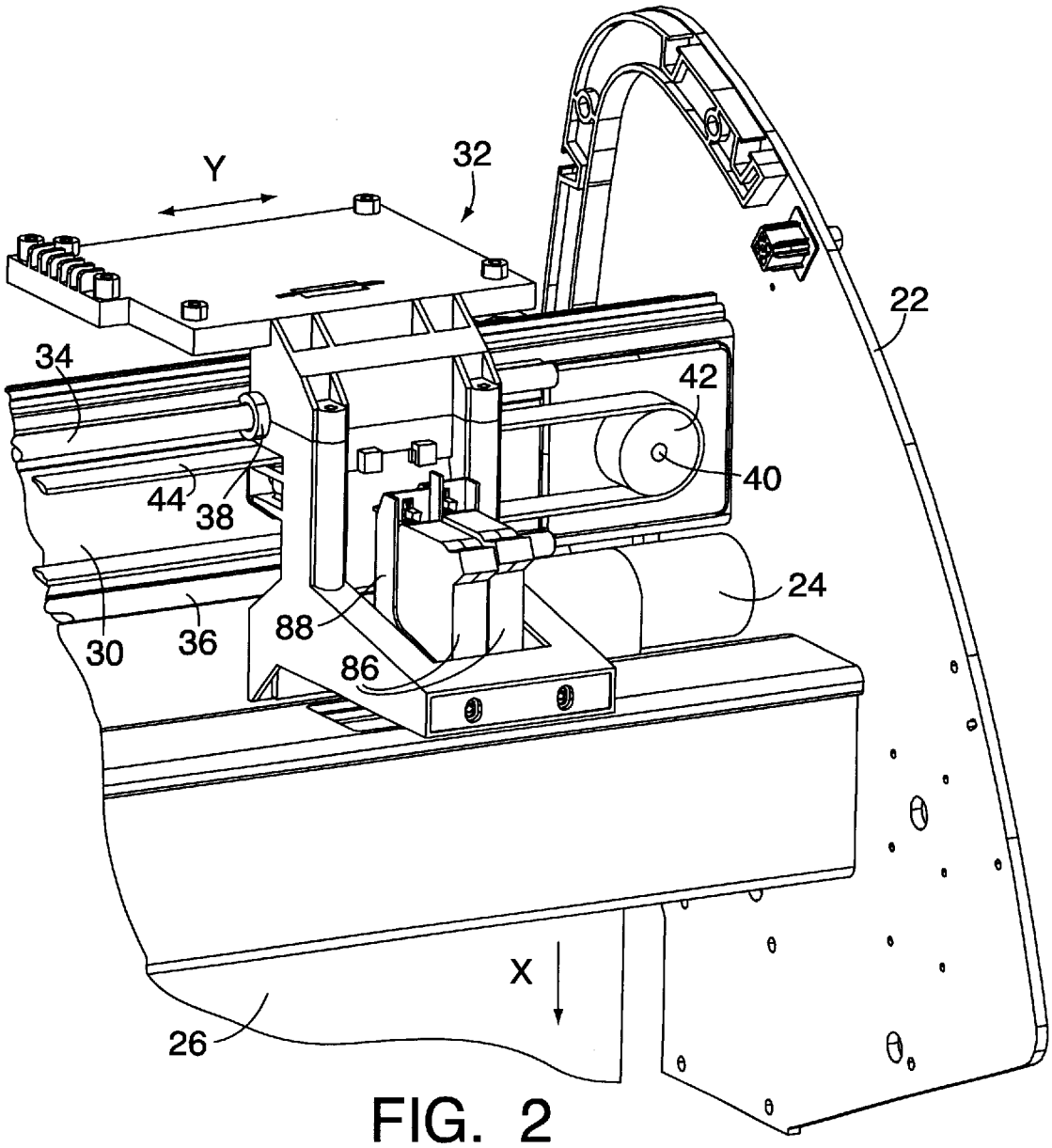
FIG. 2 is an enlarged perspective view of the apparatus of FIG. 1 showing the print head carriage coupled for movement to the frame and the web being continuously advanced through the apparatus.

As shown in FIGS. 1 and 2, an embodiment of the apparatus of the present invention is generally designated by the reference numeral 20. The apparatus 20 includes a frame 22 having a roller 24 rotatably coupled thereto for supporting and continuously advancing a web of work material 26 through the apparatus longitudinally of itself in a first coordinate direction as indicated by the arrow labeled "X." To continuously advance the web, the roller 24 is driven by suitable means, such as, but not limited to a motor (not shown). The motor is responsive to commands issued from a programmable controller 28 coupled to the apparatus 20 and having data corresponding to a graphic to be printed onto the web 26, stored therein in a machine-readable format.

As shown in FIG. 2, an elongated carriage support 30 is mounted to the frame 22 and extends along the length of the roller 24 approximately parallel thereto. A print head carriage 32 is slidably coupled to the carriage support 30 via upper and lower rails 34 and 36 respectively. The upper and lower rails, 34 and 36 are attached to the carriage support 30 and are approximately parallel to one another as well as to the roller 24. The upper rail 34, and the lower rail 36 each extend through a bushing 38 (only one shown) mounted on the print head carriage 32. During operation, the print head carriage 32 slides back-and-forth along the upper and lower rails in the Y coordinate direction in response to commands issued from the controller 28. To allow the print head carriage 32 to slide smoothly along the upper and lower rails 34 and 36, the bushings 38 must be made of a suitable material, such as, but not limited to polytetrafluoroethylene. Moreover, while bushings 38 have been shown and described, the present invention is not limited in this regard as other components known to those skilled in the pertinent art to which the present invention pertains, such as linear roller-type bearings, may be substituted without departing from the broader aspects of the present invention.

Referring to FIGS. 1 and 2, a stepper motor (not shown) is mounted to a back side of the carriage support 30 at a first end thereof, and includes a rotatable shaft 40 extending through the carriage support. A first pulley 42 is mounted on the shaft 40 and drivingly engages belt 44. A second pulley 46 is rotatably mounted to the carriage support at a second end thereof and also engages the belt 44. As will be explained in detail herein below, the belt 44 is attached at its ends to the printhead carriage 32. Preferably, the belt 44 is a timing belt having a plurality of equally spaced teeth along its length, and the first and second pulleys 44 and 46 are timing pulleys each defining a plurality of circumferentially spaced mating teeth adapted to engage the teeth on the timing belt. However, the present invention is not limited in this regard as other types of belts and pulleys known to those skilled in the pertinent art to which the present invention pertains, such as V-belts and sheaves, may be substituted without departing from the broader aspects of the present invention.

Figure 3:
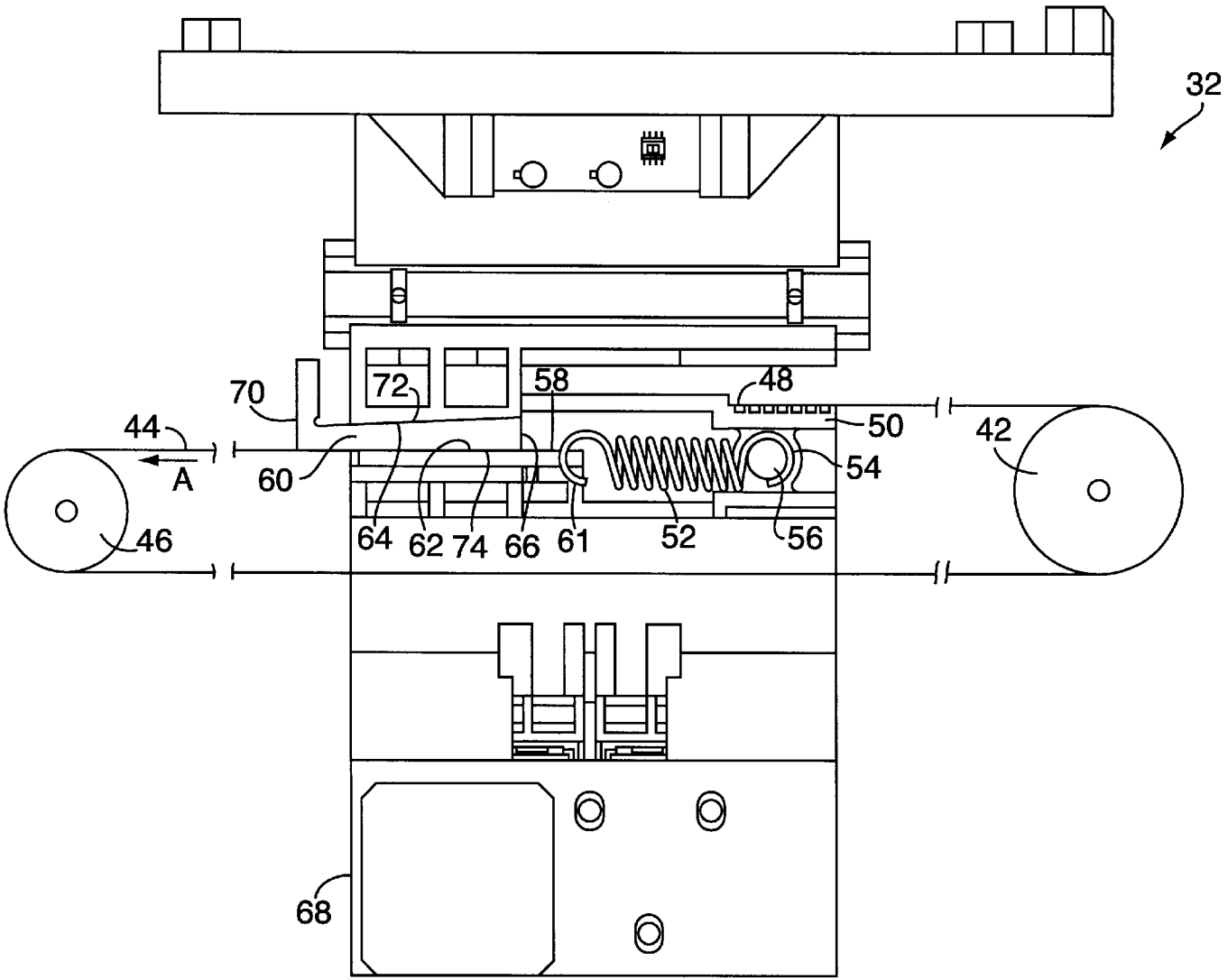
FIG. 3 is a partially schematic top view of the print head of FIG. 2, showing the manner in which a timing belt, is attached to the print head carriage, for driving the print head carriage across the apparatus of FIG. 1.

As shown in FIG. 3, the belt 44 engages the pulleys 40 and 42 and is attached at a first end 48 to one side of the print head carriage 32 via clamp 50. A coil spring 52 is mounted via first hooked end 54 onto a protrusion 56 extending from the print head carriage 32. A second end 58 of the belt 44 extends through a channel 60 located on the print head carriage 32 opposite to the clamp 50 and is retained by a second hooked end 61 defined by the spring 52. The length of the belt 44 being such that mounting the belt to the second hooked end of the spring 52 causes the spring to extend, thereby exerting a tensioning force on the belt.

Still referring to FIG. 3, the channel 60 includes opposed walls 62 and 64 with wall 64 progressively tapering from a first end 66 of the channel 60 towards an outside wall 68 of the print head carriage 32. A retaining member 70 is slidably positioned in the channel 60 and includes a first surface 72 defining a taper adapted to mate with the taper on the wall 64. The retaining member 70 also defines a second surface 74 opposite to the first surface and adjacent to the belt 44. In this configuration, the retaining member 70 slides along the tapered wall 64 of the channel 60 thereby releasably locking the belt 44 in place when a force is exerted thereon in the direction indicated by the arrow "A", thereby preventing any slack in the belt, or loosening during operation.

Figure 4:
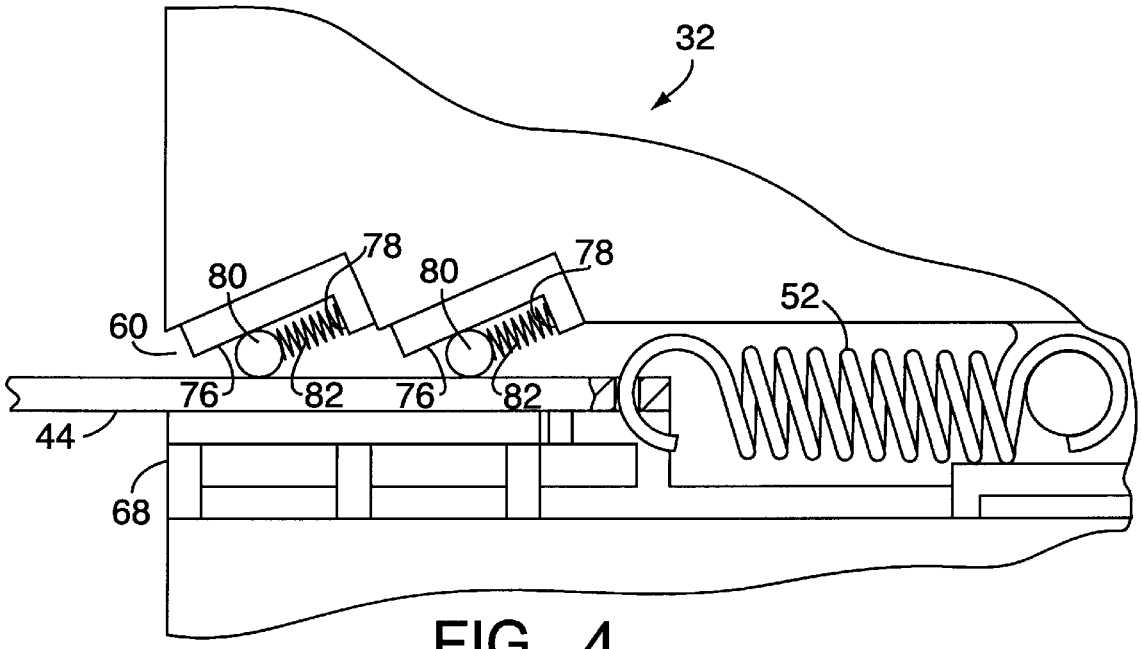
FIG. 4 is a partial top view of the print head of FIG. 2, showing an alternate manner of attaching the timing belt to the print head carriage.
Figure 5:
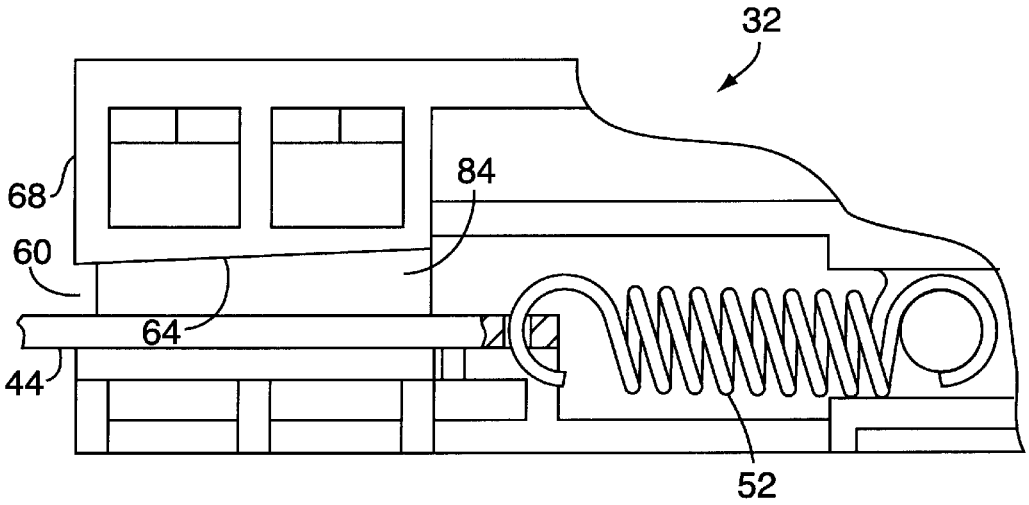
FIG. 5 is a partial schematic top view of the print head of FIG. 2, showing an alternate manner of attaching the timing belt to the print head carriage.

Alternatively, and as shown in FIG. 4, instead of employing a retaining member 70 as described above, the channel 60 can include a pair of tapered walls 76 aligned with one another, each defining a lip 78 projecting therefrom. A ball 80 is positioned between each wall 78 and the belt 44, with a spring 82 interposed between each ball and lip for biasing the balls against the belt. Accordingly, during operation the spring 52 will exert tension on the belt 44 while the spring loaded balls 80 will prevent the belt from loosening, by becoming wedged between the tapered walls 76 and the belt 44 releasably locking the belt in place. While spring loaded balls have been shown and described, the present invention is not limited in this regard as other components such as a spring loaded wedge 84, as shown in FIG. 5 can be substituted without departing from the broader aspects of the present invention.

Figure 6:
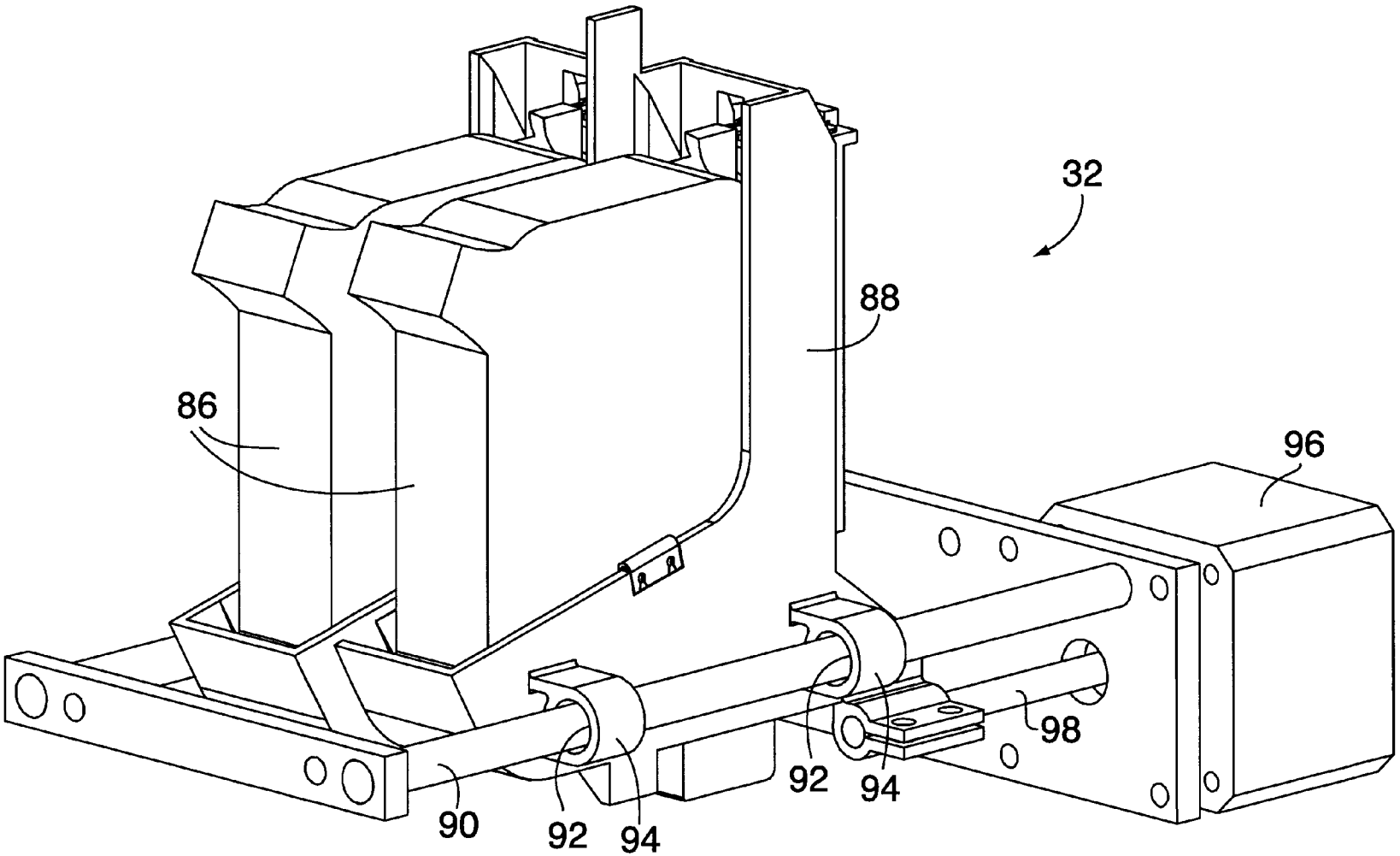
FIG. 6 is an enlarged perspective view of the print head carriage of FIG. 1, showing a pair of print heads in a partially forward position.

As shown in FIG. 6, the printhead carriage 32 includes two print heads 86 releasably mounted to a carrier 88 which in turn is slidably mounted to the carriage via a pair of rails (one shown) 90. The rails 90 project outwardly from the print head carriage 32 each extending through a pair of apertures 92 defined by bosses 94 outwardly depending from the carrier 88. An actuator 96 is mounted to the print head carriage 32 and includes an actuating member 98 that extends through the print head carriage and engages the carrier 88. Preferably, the actuator 96 is a stepper motor, and the actuating member 98 is a lead screw rotatably coupled to the stepper motor. Upon rotation of the lead screw, the carrier 88 and print heads 86 move between a forward and rearward position in response to commands issued from the controller 28, FIG. 1. However, the present invention is not limited in this regard as other types of actuators, and actuating members known to those skilled in the pertinent art to which the present invention pertains, such as a pneumatic cylinder having an extendible cylinder rod, can be substituted without departing from the broader aspects of the present invention. In addition, while the illustrated embodiment shows two print heads 86, the present invention is not limited in this regard as one, or a plurality of print heads staggered relative to one another can also be employed.

Figure 7:
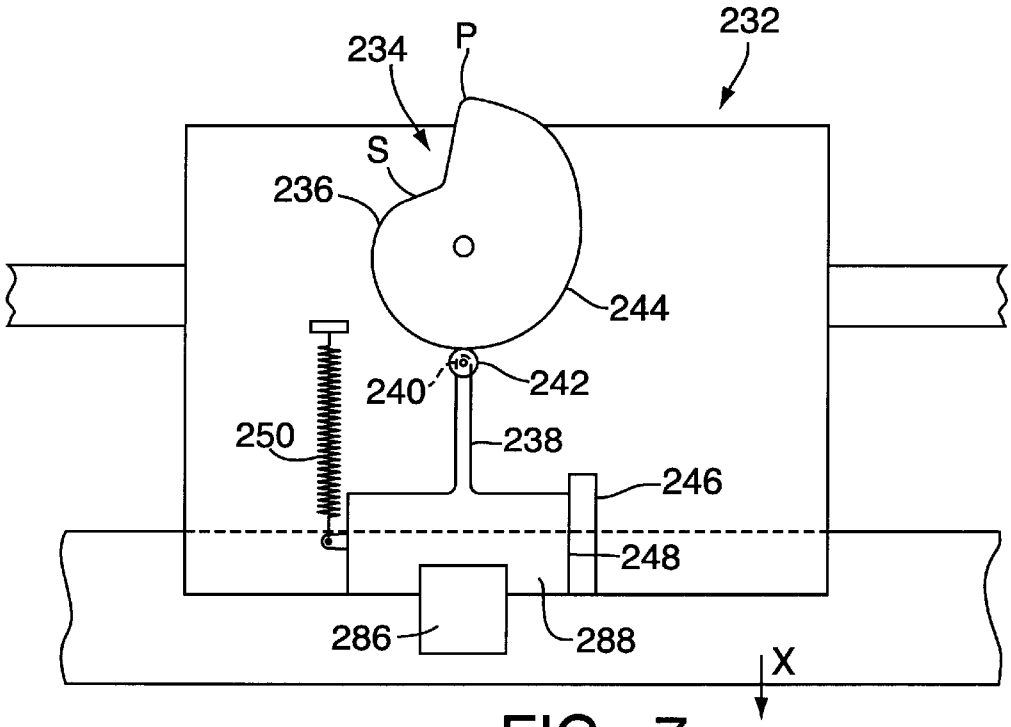
FIG. 7 is a partial front view of an embodiment of the print head carriage showing a cam mechanism for moving the print head between a forward and a rearward position.

A second embodiment of the print head carriage of the present invention is shown in FIG. 7 and generally designated by the reference numeral 232 and is similar in many respects to the print head carriage 32 described above. Therefore, like reference numerals preceded by the number 2 are used to indicate like elements. The print head carriage 232 differs from the print head carriage 32 in that instead of an actuator and actuating member, the print head is moved between the forward and rearward positions via a cam mechanism 234.

The cam mechanism 234 includes a cam 236 mounted to the print head carriage 232 and rotatable by a suitable drive, such as but not limited to a stepper motor (not shown). A carrier 288 having a print head 286 releasably mounted thereon, is slidably coupled to the print head carriage 232 for movement between a forward and a rearward position. The carrier 288 includes an extension 238 projecting therefrom and having an end 240 to which a wheel 242 is rotatably mounted and engages a peripheral surface 244 defined by the cam 236. A guide 246 extends form the print head carriage 232 and slidably engages an edge 248 of the carrier 288 to maintain the alignment of the carrier during movement between the forward and rearward position. A biasing member, shown in the illustrated embodiment as a spring 250 is mounted at one end to the carrier 288 and at an opposite end to the print head carriage 232 for urging the carrier to the rearward position. During operation, as the cam 234 rotates, the carrier 288 and thereby the print head 286 moves from the rearward toward the forward position until such time as the wheel 242 encounters the point labeled "P", FIG. 7. At this point, the force exerted on the carrier 288 by the spring 250 causes the carrier 288 to return to the rearward position, and the wheel 242 to engage the surface labeled "S".

Figure 8:
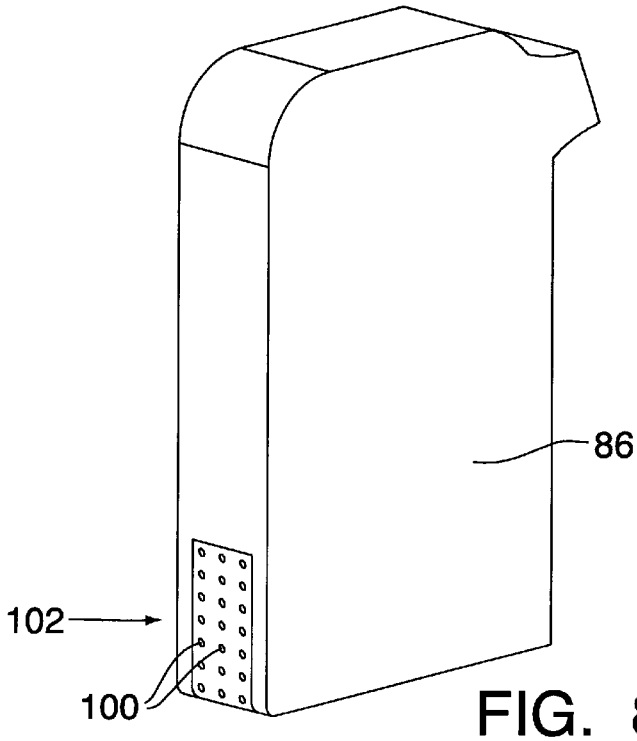
FIG. 8 is a perspective view of one of the print heads of FIG. 6 showing an array of printing elements.

As shown in FIG. 8, each print head 86, FIG. 1, or 286, FIG. 2, includes a plurality of discrete print elements 100 arranged in a matrix-like source array 102. The print elements 100 are in communication with an ink reservoir (not shown) so that during operation, as the print head carriage 32, FIGS. 1 and 2, or 232, FIG. 7 traverses the web 26, ink is transferred via the source array 102 of print elements 100 onto the web in response to commands issued from the controller 28. While an ink-jet-type print head has been shown and described, the present invention is not limited in this regard as other print heads known to those skilled in the pertinent to which the invention pertains, such as dot matrix or thermal print heads may be substituted without departing from the broader aspects of the present invention.

Referring to FIGS. 1 and 2, as well as to FIG. 9, the operation of the apparatus 20 will be explained in detail. During operation, while the web 26 is continuously advanced in the X direction at a velocity $\upsilon_{wx}$ the belt 44 causes the print head carriage 32, and thereby the source array 102 to repetitively traverse the web 26 in response to commands issued from the controller 28. While the print head carriage 32 traverses the web 26, the actuator 96 causes the carrier 88 and thereby the print heads 86 to move between the rearward and forward positions.

Figure 9:
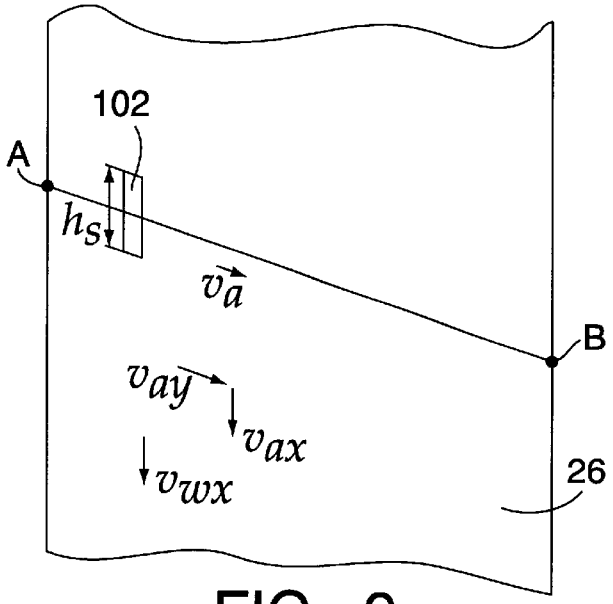
FIG. 9 is a schematic view of a path followed by the print head, relative to the frame, during operation of the apparatus of FIG. 1.
Figure 10:
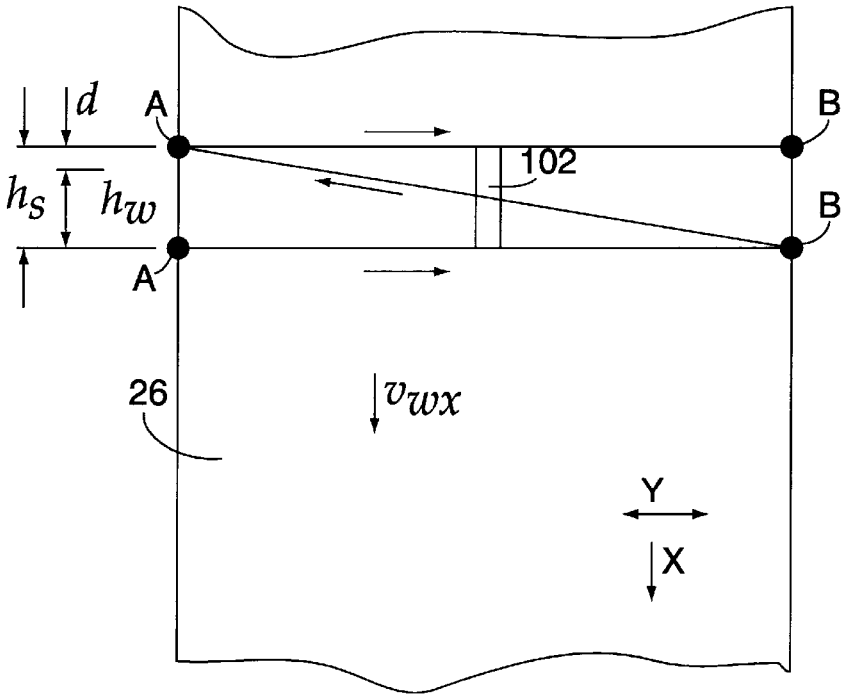
FIG. 10 is a schematic view of the path followed by the print head of FIG. 9 relative to the continuously advancing web.

Referring to FIG. 9 the above-described motion causes the print heads 86 and thereby the source array 102, FIG. 7 to trace a path across the web 26 relative to the frame, that includes a scan segment extending from the point labeled A to the point labeled B, and a repositioning segment extending from points B to A. The scanning array 102 traverses the scan segment from point A to point B at an overall velocity $\upsilon_a$. The velocity $\upsilon_a$ has first and second velocity components in the X and Y coordinate directions, $\upsilon_{ax}$ and $\upsilon_{ay}$ respectively, where $\upsilon_{ax}$ is the velocity at which the actuator 96 moves the carrier 88 from the rearward toward the forward position in the X coordinate direction and is equal to the velocity of the continuously advancing web $\upsilon_{wx}$. Accordingly, and as best seen in FIG. 10 which depicts the path followed by the source array 102 relative to the web 26, the source array in traversing the scan segment AB scans a swath on the web parallel to the Y coordinate direction and having a swath height $h_s$.

Referring back to FIG. 9, the second velocity component corresponds to the rate at which the print head carriage 232 moves across the web 26 in the Y coordinate direction and is such that in the time required for moving the scanning array 102 along the full extent of the scan segment AB the web 26 advances a distance $h_w$ in the X coordinate direction that is less than the swath height $h_s$. Upon traversing the scan segment AB the source array 102 travels along the repositioning segment BA such that prior or equal to a time taken for the web 26 to advance a distance d, where $d=h_s-h_w$, the source array 102 is repositioned for immediate movement along the scan segment AB. Referring once again to FIG. 10, as the above-described process is repeated and the web 26 is continuously advanced in the X coordinate direction, successive swaths of the web are scanned by the source array 102 parallel to the Y coordinate direction and immediately adjacent to one another. As these successive swaths are scanned the desired graphic is printed on the web 26 in response to commands issued from the controller 28.

Within the general framework of movements of the web 26 and the print head 86 discussed above and below, the controller 28 can be programmed to analyze the print sequence to alter the web and/or source array velocity to allow the print heads 86 to be repositioned more quickly than otherwise possible when white space is encountered. When the print head(s) within source array 102 are transferring ink, or other print medium, the print head 86 defines a maximum print head velocity thus a maximum velocity of source array 102 and in turn a maximum web velocity, max. $v_{wx}$. However, in white space the print head velocity can exceed the maximum print head velocity and there is no required fixed relationship between print head velocity and web velocity.

For example in the case of white space within a lineal line, when white space is encountered within the line the print head velocity can be increased above the maximum print head velocity, which will necessitate a corresponding increase in the web velocity such that the print head reaches the next lineal location where printing is to commence. In the case of longitudinal white space, the web velocity is increased, but the print head velocity could be any positive or negative value, or zero depending upon the lineal location where the transfer of ink, or other print medium, is to resume. An example of where the print head velocity would be zero is where the print head is in the proper lineal position, but the web needs to be longitudinally advanced.

While the operation of the apparatus 20 has been described above with reference to the print head carriage 32 as shown in FIGS. 1 and 2, the description is also applicable to the print head carrier 232, shown in FIG. 7. The difference being that instead of the lead screw 98 being employed to advance the carrier 88, the cam 236 engages the carrier 288 and advances the print head 286 between the rearward and forward positions at the velocity $\upsilon_{ax}$.

Alternatively, a scanning array of print elements can be selected from the source array 102, such that during operation as the print head traverses the web 26 along a scan segment AB, groups of printing elements comprising the scanning array are selectively activated causing the scanning array to move across the source array 102, in the X coordinate direction at a velocity $\upsilon_{ax}$, relative to the frame 22 and equal to the web velocity $\upsilon_{wx}$.

While the motion of the print head 86 and thereby the source array of printing elements 102 has been illustrated in FIGS. 9 and 10 as being back-and-forth along the line segment defined by points A and B, the present invention is not limited in this regard as the print head 86 can trace other paths relative to the frame 22. For example, and as schematically illustrated in FIGS. 11 and 12, the source array 102 can follow a figure-8-shaped path consisting of first and second scan segments AB and CD respectively, and first and second repositioning segments BC and DA respectively.

During operation of the apparatus 20, the source array 102 initially traverses the first scan segment AB from the first end labeled A to the second end labeled B at a velocity $\upsilon_{1a}$ having a first velocity component $\upsilon_{1ax}$ in the X coordinate direction equal to the velocity of the web $\upsilon_{wx}$, and a second velocity component $\upsilon_{1ay}$ in the Y coordinate direction. Accordingly, the source array scans a first swath on the web parallel to the Y coordinate direction having a first swath height $h_{1s}$.

As the source array traverses the first scan segment, the second velocity component $\upsilon_{1ay}$ is such that in the time required for the array to traverse the full extent of the first scan segment, the web advances a distance $h_{1w}$ in the X coordinate direction that is less than the swath height $h_{1s}$. Upon traversing the full extent of the first scan segment the source array next traverses the first repositioning segment from point B to point C in a time less than or equal to the time taken for the web to advance a distance $d_1$, where $d_1=h_{1s}-h_{1w}$. The print head is now positioned for immediate movement along the second scan segment CD.

Figure 11:
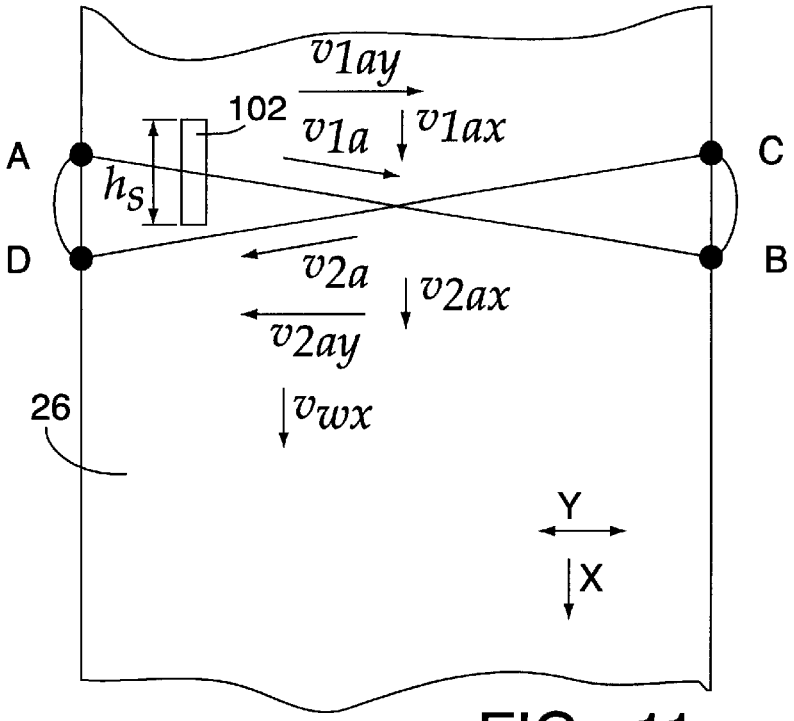
FIG. 11 is a schematic view of an alternate path followed by the print head, relative to the frame, during operation of the apparatus of FIG. 1.
Figure 12:
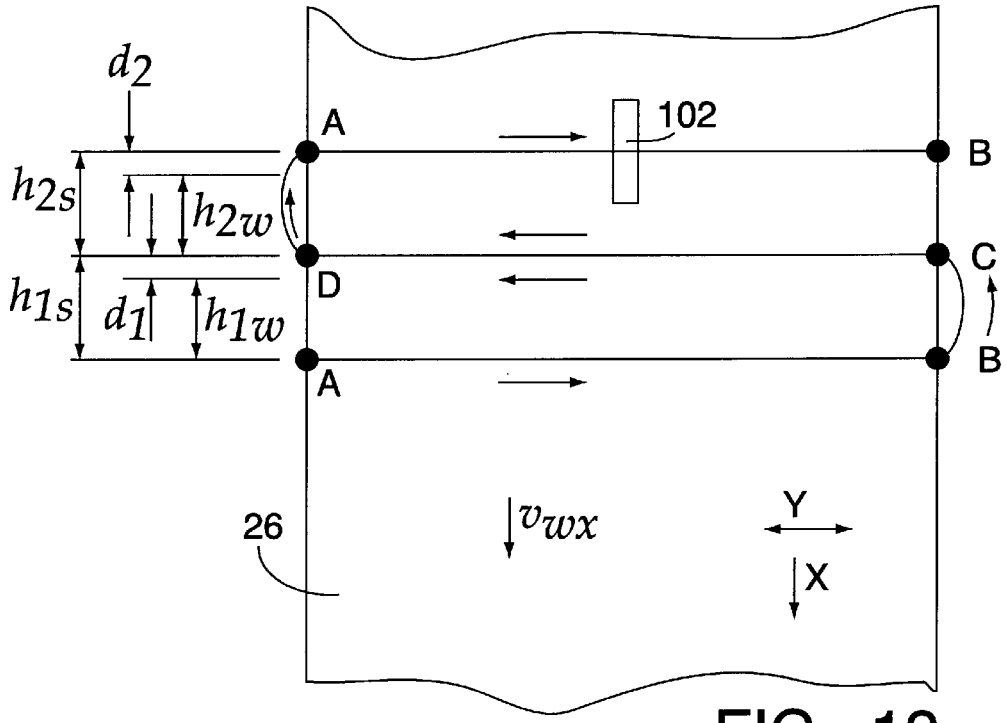
FIG. 12 is a schematic view of the path followed by the print head of FIG. 11 relative to the continuously advancing web.

Still referring to FIG. 11, the source array next traverses the second scan segment at a velocity $-\upsilon_{2a}$ defined by a first velocity component $\upsilon_{2ax}$ in the X coordinate direction equal to the velocity of the web $\upsilon_{wx}$, and a second velocity component $-\upsilon_{2ay}$. In traversing the second scan segment from point C to point D, the source array scans a second swath on the web parallel to the Y coordinate direction, having a second swath height $h_{2s}$. Moreover, the velocity component $-\upsilon_{2ay}$ is such that in the time required for the scanning array to traverse the full extent of the second scan segment the web advances the distance $h_{2w}$ in the X coordinate direction which is less than the second swath height space $h_{2s}$.

Accordingly, upon traversing the full extent of the second scan segment the source array travels along the second repositioning segment from point D to point A in a time less than or equal to the time taken for the web to advance a distance $d_2$, where $d_2=h_{2s}-h_{2w}$. In this manner the print head is once again positioned for immediate movement along the first scan segment, such that the path traced by the source array is figure-8-shaped relative to the frame.

As shown in FIG. 12, when the figure-8-shaped path of FIG. 11 is viewed relative to the continuously advancing web 26, the source 102 array scans two successive swaths of said continuously advancing web immediately adjacent to one another and parallel to the Y coordinate direction, with each traverse of the figure-8-shaped path. The source array 102 will transfer swaths of print corresponding to the desired graphic, onto the web 26 in response to commands issued from the controller 28, FIG. 1.

While the present invention has been shown and described in FIGS. 9–12 as involving the movement of the entire source array 102 in the X direction to achieve the velocity components $\upsilon_{ax}$, $\upsilon_{1ax}$ and $-\upsilon_{2ax}$ that are equal to the web velocity $\upsilon_{wx}$, the present invention is not limited in this regard. For example, and referring to FIG. 8, a scanning array 104 that comprises a portion of the source array 102 can be selectively activated in response to commands issued from the controller 28. During operation, as the print head 86 traverses a scan segment on the web 26, the scanning array 104 shifts along the source array 102, in the X coordinate direction at the velocity $\upsilon_{ax}$, $\upsilon_{1ax}$ or $-\upsilon_{2ax}$. Accordingly, the scanning array scans successive swaths on the web 26 parallel to the Y coordinate direction and immediately adjacent to one another.

While the source array 102 has been illustrated as traversing the entire width of the web 26, the present invention is not limited in this regard. Depending on the graphic being printed, the source array 102 may only need to traverse a portion of the web's width. In addition, the web velocity $\upsilon_{wx}$ can vary depending on the complexity of the graphic being printed and/or the width of the web 26. The velocity $\upsilon_{wx}$ can also vary depending on the speed at which the controller 28, FIG. 1 can process the data corresponding to the graphic being printed. The velocity of the print head carriage 32, FIG. 1, or 232, FIG. 7 and thereby the source array 102 can be adjusted to compensate for changes in the web velocity $\upsilon_{wx}$ in response to commands issued from the controller.

Figure 13:
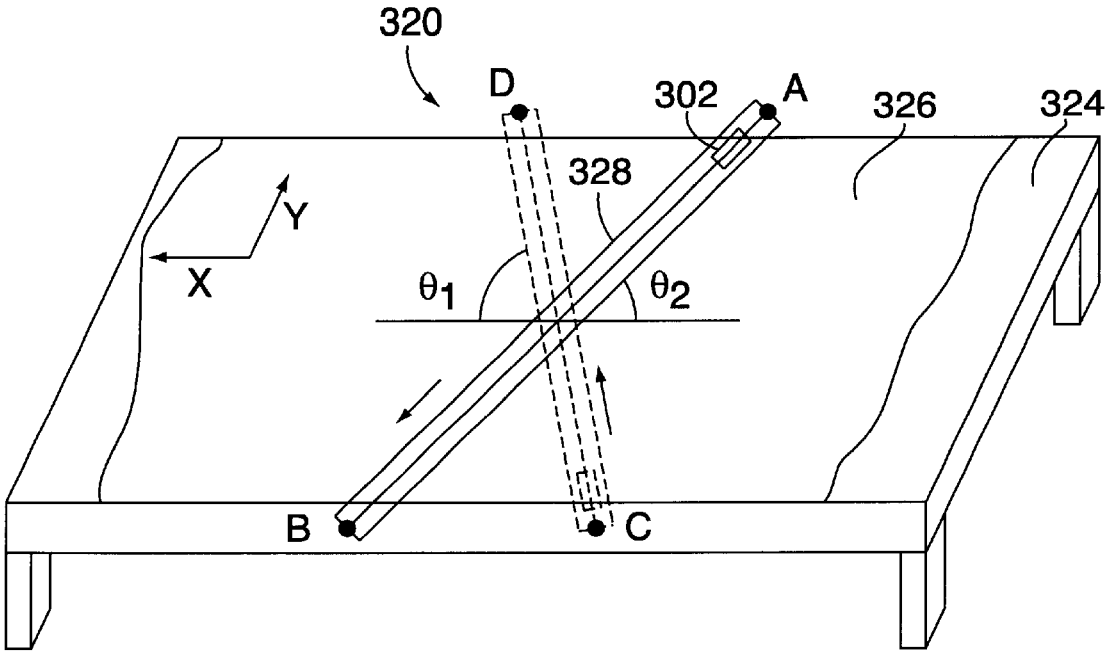
FIG. 13 is a partially schematic perspective view of an alternate embodiment of the apparatus of FIG. 1, showing a flatbed -type printing device.

FIG. 13 illustrates an alternate embodiment of the apparatus of the present invention that includes many of the same features as the apparatus 20. Accordingly, like elements will be designated by the same element numbers preceded by the numeral 3. While the apparatus 20, FIG. 1 has been shown and described as including a roller 24 that defines a support surface for the advancing web 26, the present invention is not limited in this regard. As shown in FIG. 13, a flatbed type printer 320 having a substantially flat work support surface 324 can also be employed with the source array 302 traversing the web 326 in the same manner and along the same paths as described herein-above.

Alternatively and as shown in FIG. 13, the above described figure-8 shaped path can be traced by employing a print head carriage support 326 pivotally coupled to the apparatus 320 for movement between a first angle $\emptyset_1$ relative to the X coordinate direction and a second angle $\emptyset_2$, equal and opposite to the first angle. During operation, the source array 302 travels along the carriage support 326 oriented at the angle $\emptyset_1$. Upon reaching the end of the first scan segment the carriage support pivots to the angle $\emptyset_2$, thereby positioning the source array 302 to traverse the second scan segment. This process is repeated until the desired graphic is printed onto the continuously advancing web.

While preferred embodiments have been shown and described, various modifications and substitutions may be made without departing from the spirit and scope of the invention. Accordingly, it is to be understood that the present invention has been described by way of example, and not by limitation.

What is claimed is:

1. A method for varying the rate of advancement of a continuously advancing web of sheet-type work material through a printer, comprising the steps of:

providing a printer having, means for continuously advancing a web of sheet-type work material therethrough in a first coordinate direction longitudinal of itself, and a print head movable, in response to commands signals generated by a controller, in said first coordinate direction, and a second coordinate direction approximately perpendicular to said first coordinate direction to allow lineal lines of print approximately perpendicular to said first coordinate direction, to be transferred from said print head onto said continuously advancing web of work material;

providing a controller in communication with said printer and having print data corresponding to a desired graphic stored therein in machine-readable format;

programming said controller to analyze said graphic stored therein to identify white space in said graphic and to increase rate of movement of a respective one, or both of said print head and said web to accelerate past said white space;

presenting said web to said printer; and operating said printer via command signals generated by said controller, to advance said web through said printer and to cause said print head to transfer print media onto said web in accordance with said stored graphic and to accelerate one or both of said print head and said web over said white space.

2. A method for varying the rate of advancement of a continuously advancing web of sheet-type work material through a printer as defined by claim 1 wherein:

said printer comprises, a frame;

means for continuously advancing said web in said first coordinate direction longitudinally of itself at a velocity $\upsilon_{wx}$ relative to said frame;

at least one print head coupled to said frame for movement relative thereto, said print head including a plurality of print elements arranged in a scanning array extending in said first coordinate direction;

means for repetitively moving said scanning array of print elements relative to said frame along a path including at least one scan segment and one repositioning segment at such a velocity $\upsilon_a$ related to said web velocity $\upsilon_{wx}$ that as said scanning array traverses said scan segment of the path said scanning array has a first velocity component $\upsilon_{ax}$ in said first coordinate direction, and a second velocity component $\upsilon_{ay}$ in a second coordinate direction perpendicular to said first coordinate direction;

said means for repetitively moving said scanning array of print elements further being such that said first velocity component $\upsilon_{ax}$ is equal to $\upsilon_{wx}$ so that said scanning array in traversing said scan segment of the path scans a swath on said web parallel to said first coordinate direction and having a swath height $h_s$;

said means for repetitively moving said scanning array of print elements further being such that said second velocity component $\upsilon_{ay}$ is such that in the time required for moving said scanning array along the full extent of said scan segment of the path said web advances a distance $h_w$ in said first coordinate direction that is less than said swath height $h_s$; and wherein upon traversing said scan segment said scanning array travels along said repositioning segment such that prior or equal to a time taken for said web to advance a distance d, where $d=h_s-h_w$, said print head is repositioned for immediate movement along a scan segment thereby causing successive swaths of said web scanned by said scanning array to be positioned on said continuously advancing web immediately adjacent to one another; and wherein said step of operating said controller further includes increasing a respective one, or all of said velocity components $\upsilon_w$, $\upsilon_{ax}$, $\upsilon_{ay}$ over said white space.

3. The method of claim 1 wherein the step of operating said printer further comprises controlling at least one of said printer head or said web to move at a greater velocity over said white space in said graphic than when said print head moves over said advancing web during transferring said print media onto said web in accordance with said stored graphic.

4. A method for varying the rate of advancement of a continuously advancing web of sheet-type work material through a printer, comprising the steps of:

providing a printer having, a frame;

means for continuously advancing said web in said first coordinate direction longitudinally of itself at a velocity $\upsilon_{wx}$ relative to said frame;

at least one print head coupled to said frame for movement relative thereto, said print head including a plurality of print elements arranged in a scanning array extending in said first coordinate direction;

means for repetitively moving said scanning array of print elements relative to said frame along a path including at least one scan segment and one repositioning segment at such a velocity $\upsilon_a$ related to said web velocity $\upsilon_{wx}$ that as said scanning array traverses said scan segment of the path said scanning array has a first velocity component $\upsilon_{ax}$ in said first coordinate direction, and a second velocity component $\upsilon_{ay}$ in a second coordinate direction perpendicular to said first coordinate direction;

said means for repetitively moving said scanning array of print elements further being such that said first velocity component $\upsilon_{ax}$ is equal to $\upsilon_{wx}$ so that said scanning array in traversing said scan segment of the path scans a swath on said web parallel to said first coordinate direction and having a swath height $h_s$;

said means for repetitively moving said scanning array of print elements further being such that said second velocity component $\upsilon_{ay}$ is such that in the time required for moving said scanning array along the full extent of said scan segment of the path said web advances a distance $h_w$ in said first coordinate direction that is less than said swath height $h_s$; and wherein upon traversing said scan segment said scanning array travels along said repositioning segment such that prior or equal to a time taken for said web to advance a distance d, where $d=h_s-h_w$, said print head is repositioned for immediate movement along a scan segment thereby causing successive swaths of said web scanned by said scanning array to be positioned on said continuously advancing web immediately adjacent to one another;

providing a controller in communication with said printer and having print data corresponding to a desired graphic stored therein in machine-readable format;

programming said controller to analyze said graphic stored therein to identify white space in said graphic and to increase rate of movement of a respective one, or both of said print head and said web to accelerate past said white space;

presenting said web to said printer; and operating said printer via command signals generated by said controller, to advance said web through said printer and to cause said print head to transfer print media onto said web in accordance with said stored graphic and to accelerate one or both of said print head and said advancing web over said white space, increasing a respective one, or all of said velocity components $\upsilon_w$, $\upsilon_{ax}$, $\upsilon_{ay}$ over said white space.

5. A method for varying the rate of advancement of a continuously advancing web of sheet-type work material through a printer, comprising the steps of:

providing a printer having, means for continuously advancing a web of sheet-type work material therethrough in a first coordinate direction longitudinal of itself, and a print head movable, in response to commands signals generated by a controller, in said first coordinate direction, and a second coordinate direction approximately perpendicular to said first coordinate direction to allow lineal lines of print approximately perpendicular to said first coordinate direction, to be transferred from said print head onto said continuously advancing web of work material;

providing a controller in communication with said printer and having print data corresponding to a desired graphic stored therein in machine-readable format;

programming said controller to analyze said graphic stored therein to identify white space in said graphic and to increase rate of movement of a respective one, or both of said print head and said web to accelerate past said white space;

presenting said web to said printer; and operating said printer via command signals generated by said controller, to advance said web through said printer and to cause said print head to transfer print media onto said web in accordance with said stored graphic wherein one or both of said print head and said advancing web travel at a greater velocity over said white space then when said print head is transferring print media to said advancing web.

* * * * *